US006373198B1

(12) United States Patent
Gielen et al.

(10) Patent No.: US 6,373,198 B1
(45) Date of Patent: Apr. 16, 2002

(54) INDUCTION LAMP SYSTEM AND INDUCTION LAMP

(75) Inventors: Johannes Wilhelmus Anna Maria Gielen, Eindhoven; Rene Maarten Arjan Driessens, Terneuzen; Herman Johannus Gertruda Gielen, Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/728,036

(22) Filed: Dec. 1, 2000

(30) Foreign Application Priority Data

Dec. 2, 1999 (EP) ..... 99204086

(51) Int. Cl.[7] ..... H05B 41/16

(52) U.S. Cl. ..... 315/248; 315/267; 315/344; 315/39

(58) Field of Search ..... 315/248, 267, 315/344, 347, 348, 39

(56) References Cited

U.S. PATENT DOCUMENTS 3,943,402 A * 3/1976 Haugsjaa et al. ..... 315/39
4,001,631 A * 1/1977 McNeill et al. ..... 315/39
5,479,102 A * 12/1995 El-Hamamsy et al. ..... 324/414
5,541,482 A * 7/1996 Siao ..... 315/248

FOREIGN PATENT DOCUMENTS

WO WO9323975 11/1993 ..... H05B/41/16

* cited by examiner

*Primary Examiner*—Don Wong
*Assistant Examiner*—Tuyet T. Vo

(57) ABSTRACT

Induction lamp system comprising a power supply unit, which can supply a high-frequency altenating voltage, a power supply cable connected to the power supply unit and an induction lamp connected to the power supply cable. The lamp is provided with an induction coil, and at least one electronic component is arranged between the induction coil and the power supply cable. The electronic component together with the induction coil and the power supply cable have a combined impedance Z. According to the invention, and due to the properties of the electronic component, it holds that the absolute value of the imaginary component Im(Z) of the impedance Z is smaller than the real component Re(Z) for any arbitrary length of the power supply cable.

10 Claims, 2 Drawing Sheets

INDUCTION LAMP SYSTEM AND INDUCTION LAMP

FIELD OF THE INVENTION

The invention relates to an induction lamp system comprising a power supply unit, which can supply a high-frequency alternating voltage, a power supply cable connected to the power supply unit, and an induction lamp connected to the power supply cable and comprising an induction coil, at least one electric component being arranged between the power supply cable and the induction coil.

BACKGROUND OF THE INVENTION

Induction lamps are known by virtue of their long lifetime and high efficiency which is comparable with conventional gas discharge lamps such as TL tubes. The operation of an induction lamp is also comparable therewith to a certain extent, be it that the electron current in the lamp is not generated by a voltage difference between two electrodes but by an induction coil in which a high frequency voltage is generated causing a current to flow in the gas which is enclosed in the glass envelope around the coil. The gas may be mercury vapor (coming from an amalgam) and (rare) gas. The emission of electromagnetic radiation by the gas as a result of the electric current and the conversion of this radiation into visible light by means of fluorescence is entirely comparable with a conventional gas discharge lamp.

The lamp impedance is dependent, inter alia, on the rare gas mixture and the mercury vapor pressure. The latter varies with the temperature of the amalgam. Heating of the lamp, after it has been switched on, thus initially causes fluctuations of the electrical behavior, which eventually stabilizes. The electric power supply, usually incorporating a high frequency voltage generator and a resonant circuit, is to be designed in such a way that the lamp is fed with the correct power at different impedances.

An induction lamp system as described in the opening paragraph is known from international patent specification WO 93/23975. In this system, a capacitor is arranged in series with the induction lamp and the capacitor has such a value that the lamp having a predetermined fixed value (for example, 85 W) resonates at the same frequency as the power supply unit. A property of such assemblies is that the length of the power supply cable influences the impedance which is "seen" by the power supply unit, and hence influences the resonance frequency. The value of the capacitor and of the components in the power supply unit must therefore be adapted in advance to the cable length to be used. Consequently, the cable length is predetermined for a given system, which is detrimental to the flexibility of consumer uses of such a system.

SUMMARY OF THE INVENTION

It is an object of the invention to provide an induction lamp system for a high frequency induction lamp which is suitable for different cable lengths. It is another object of the invention to provide an induction lamp system which is independent of cable lengths and is inexpensive and has a high efficiency.

To this end, the electronic component has such properties that the absolute value of the imaginary component Im(Z) of the overall impedance Z of the power supply cable, the electronic component and the induction coil is smaller than the real component Re(Z) for any arbitrary length of the power supply cable. The absolute value of the imaginary component Im(Z) of the overall impedance Z is preferably smaller than 0.50 times the real component Re(Z), more preferably smaller than 0.25 times the real component Re(Z). The aim is a completely pure real impedance so that the resonance properties of the system are entirely independent of the length of the power supply cable if use is made of a coax cable. Since the imaginary impedance is also dependent on the temperature and the mercury vapor pressure in the lamp, which increases during start-up of the lamp, this is not feasible for any arbitrary temperature, but by correct choice of the components, the imaginary component Im(Z) can be maintained within acceptable limits for any occurring temperature. The wording "arbitrary length of the power supply cable" is to be understood to mean at least any cable length between 0.2 and 4.0 meters.

The value of the real component Re(Z) of the overall impedance Z of the electronic component and the induction lamp preferably differs less than 15%, more preferably less than 8% from the characteristic impedance of the power supply cable. The two measures mentioned above, namely the substantial elimination of the imaginary component of the impedance and rendering the real component of the impedance of the induction lamp substantially equal to the characteristic impedance of the cable is referred to as characteristic termination, said measures jointly ensuring that the length of the power supply cable does not influence the impedance of the system.

The variation of the absolute value $|Z|$ of the overall impedance Z is preferably smaller than 35Ω for different cable lengths. This is advantageous because the light output of the lamp is also influenced by $|Z|$ and an approximately equal light output is generally desired for any cable length.

In a preferred embodiment, the electronic component comprises a capacitor. The above-mentioned aims can be realized in an efficient manner, inter alia, by interpositioning a capacitor of the correct value.

The power supply unit preferably comprises a resonant circuit which is adapted to the overall impedance Z for an optimal light output, the resonant circuit preferably comprising two coils and one capacitor. It has been found that this is the minimum number of components to achieve the desired result with a sufficient efficiency. Overall, the system will thus comprise two coils, two capacitors and one induction lamp (which may also be considered to be a coil).

The invention also relates to an induction lamp comprising an induction coil and an electronic component, which induction lamp can be connected by means of a power supply cable to a power supply unit, which can supply a high frequency alternating voltage, the electronic component being arranged between the induction coil and a connection point for the power supply cable, said electronic component having such properties that the absolute value of the imaginary component Im(Z) of the overall impedance Z of the power supply cable to be connected, the electronic component and the induction coil is smaller than the real component Re(Z) for any arbitrary length of the power supply cable.

These and other aspects of the invention are apparent from and will be elucidated with reference to the embodiments described hereinafter.

DETAILED DESCRIPTION OF THE INVENTION

Figure 1:
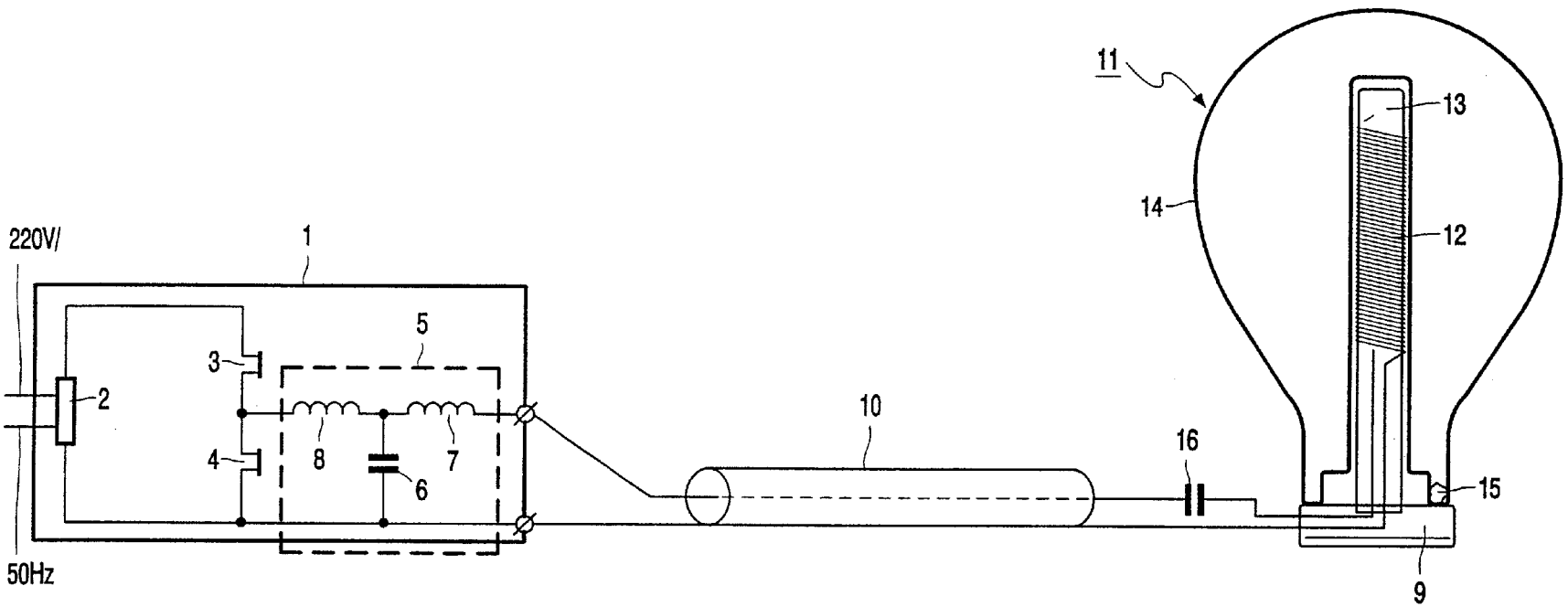
FIG. 1 shows diagrammatically an induction lamp system.
Figure 2A:
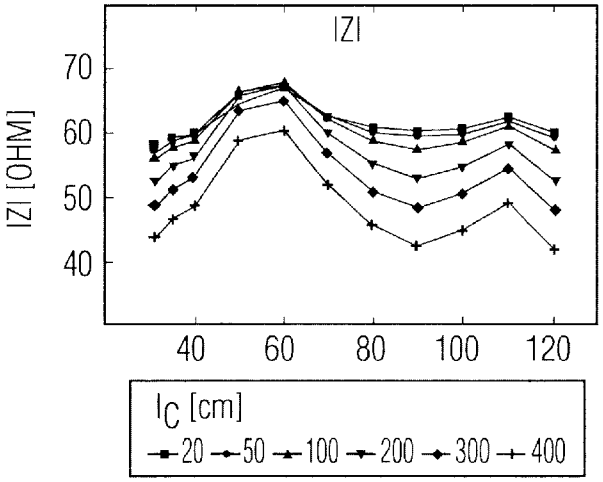
FIG. 2 is a graph showing the relation between the overall impedance of the power supply cable, the electronic component and the induction coil, and the amalgam temperature of the induction lamp for different power supply cable lengths.
Figure 2C:
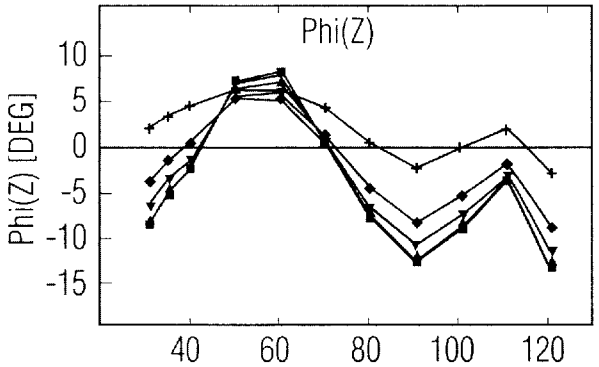
Figure 2B:
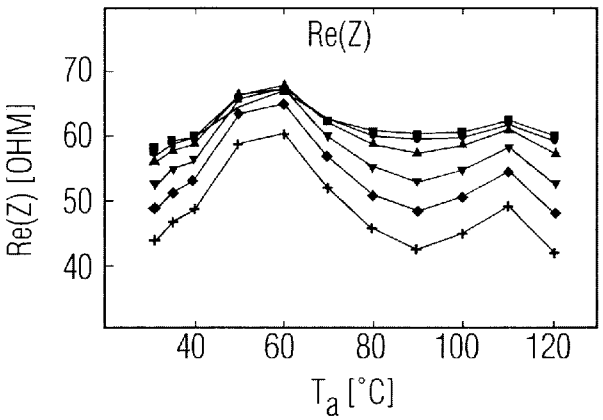
Figure 2D:
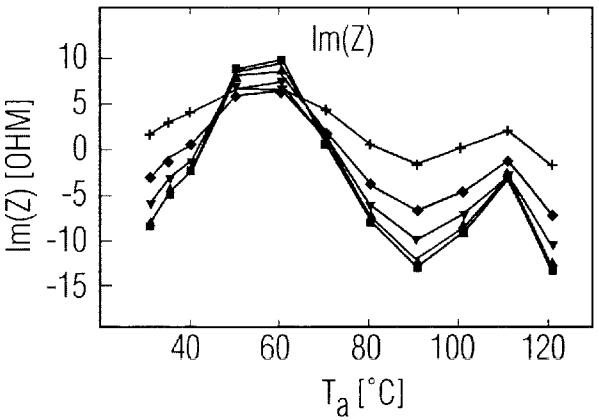

Referring to FIG. 1, an induction lamp system comprises a power supply unit 1 in which a high-frequency voltage can be generated. To this end, the power supply unit 1 has an input which is connected to a mains voltage (220 V/50 Hz), a conversion network 2 in which the alternating voltage of the input is converted into a direct voltage, and a half-bridge circuit comprising two transistors 3, 4 converting this direct voltage into a high-frequency alternating voltage (189 V/2.65 MHz). Furthermore, the power supply unit comprises a resonant circuit 5 consisting of a capacitor 6 and two coils 7, 8. The resonant circuit 5 is designed in such a way that the lamp is fed with the correct power supply characteristic during start-up and in its stable operating phase. The capacitor 6 has a value of approximately 450 pF, the coil 7 has a value of approximately 12 $\mu$H and the coil 8 has a value of approximately 16.5 $\mu$H.

An induction lamp 11 is connected to the power supply unit 1 by means of a coax cable 10. The coax cable 10 may have any arbitrary length and, in this embodiment, it has a characteristic impedance of approximately 61Ω and a capacitance of approximately 105 pF/m. The induction lamp 11 has a lamp base 9 to which an induction coil 12 and a ferrite core 13 are secured, and a glass envelope 14. The glass envelope 14 is filled with a rare gas and a quantity of mercury vapor, coming from a piece of amalgam 15, and has an internal cavity which can be placed on the induction coil 12. In this embodiment, the induction lamp system has a nominal power of 85 W.

When a high-frequency current is passed through the induction coil 12, it results in a high-frequency magnetic field in the ferrite core 13 and in the glass envelope 14.

Due to this high-frequency magnetic field, a current is generated in the glass envelope 14, which current is mainly conveyed by electrons and mercury ions. The electrons in the current generated in this manner collide with other mercury atoms so that their electrons are brought to a higher energy state. When the atoms fall back to their original energy state, they emit electromagnetic radiation, in this case ultraviolet radiation. The inner side of the glass envelope 14 is coated with a layer of fluorescent material which ensures that the ultraviolet radiation emitted by the gas mixture is converted into visible light.

A capacitor 16, which is connected to the core wire of the coax cable 10, is arranged between the coil 12 and the coax cable 10. The capacitor 16 has a value of approximately 440 pF. By interpositioning the capacitor 16 on the lamp side, it is achieved that the power supply unit 1 "sees" a mainly real impedance which is approximately equal to the characteristic impedance of the coax cable 10. As a result, the lamp 11 and the capacitor 16 jointly constitute a characteristic termination of the coax cable 10, and the resonance properties of the system become largely independent of the length of the coax cable 10, which will be further elucidated with reference to FIG. 2.

FIG. 2 shows the relation between the overall impedance of the coax cable 10, the capacitor 16 and the induction lamp 11, and the amalgam temperature ($T_a$) of the induction lamp 11 for different lengths ($l_c$) of the coax cable 10. The lamp 11 contains a quantity of solid amalgam from which a quantity of mercury changes to the vapor phase, dependent on the temperature. The mercury vapor pressure in the lamp 11 is thus dependent on the temperature maintenance in the lamp 11, particularly on the temperature ($T_a$) of the solid quantity of amalgam. After start-up of the lamp 11, this temperature ($T_a$) increases to a maximum value between 60° C. and 120° C., dependent on the ambient conditions, so that the quantity of mercury vapor in the lamp 11 acquires a value which is not predetermined, which results in a fluctuation of the impedance of the lamp 11.

The four different partial graphs consecutively show the absolute value |Z|, the phase shift Phi(Z), the real component Re(Z) and the imaginary component Im(Z) of the impedance of the system described above with reference to FIG. 1. The graphs show that for any length ($l_c$) and any temperature ($T_a$), the imaginary component Im(Z) is within the range [−15Ω, +10Ω], while the real component Re(Z) is within the range [+41Ω, +69Ω]. It is therefore achieved by virtue of the characteristic termination that the absolute value of the imaginary component is smaller than the real component in any situation, particularly smaller than 0.25 times the real component, so that the power supply unit 1 mainly sees a real impedance. It is also achieved that the absolute value |Z| of the impedance is within the range of [40Ω, 69Ω], so that the light output of the lamp 11 is reasonably constant for any length ($l_c$). Without the characteristic termination described, both components Re(Z) and Im(Z) would fluctuate to a large extent for different lengths ($l_c$) of the coax cable 10 so that a substantially real impedance will not always be the result and the lamp 11 would therefore not operate optimally or would not even work at all if the electronics were not adapted to the length ($l_c$).

The embodiment described above relates to an induction lamp system having a nominal power of 85 W, but it will be evident that the principle described is applicable to any arbitrary induction lamp system. The principle of the invention may also be used for induction lamp systems of types other than that described above.

What is claimed is:

1. An induction lamp system comprising a power supply unit, which can supply a high-frequency alternating voltage, a power supply cable connected to the power supply unit, and an induction lamp connected to the power supply cable and comprising an induction coil, at least one electronic component being arranged between the power supply cable and the induction coil, characterized in that the electronic component has such properties that the absolute value of the imaginary component Im(Z) of the overall impedance Z of the power supply cable, the electronic component and the induction coil is smaller than the real component Re(Z) for any arbitrary length of the power supply cable.

2. An induction lamp system as claimed in claim 1, wherein the absolute value of the imaginary component Im(Z) of the overall impedance Z is smaller than 0.50 times the real component Re(Z).

3. An induction lamp system as claimed in claim 1, wherein the absolute value of the imaginary component Im(Z) of the overall impedance Z is smaller than 0.25 times the real component Re(Z).

4. An induction lamp system as claimed in claim 1, wherein the value of the real component Re(Z) of the overall impedance Z of the electronic component and the induction lamp differs less than 15% from the characteristic impedance of the power supply cable.

5. An induction lamp system as claimed in claim 1, wherein the variation of the absolute value |Z| of the overall impedance Z is smaller than 35Ω for different cable lengths.

6. An induction lamp system as claimed in claim 1, wherein the electronic component comprises a capacitor.

7. An induction lamp system as claimed in claim 1, wherein the power supply cable comprises a coax cable.

8. An induction lamp system as claimed in claim 1, wherein the power supply unit comprises a resonant circuit which is adapted to the overall impedance Z for an optimal light output.

9. An induction lamp system as claimed in claim 8, wherein the resonant circuit comprises two coils and one capacitor.

10. An induction lamp comprising an induction coil and an electronic component, which induction lamp can be connected by means of a power supply cable to a power supply unit, which can supply a high-frequency alternating voltage, the electronic component being arranged between the induction coil and a connection point for the power supply cable, characterized in that the electronic component has such properties that the absolute value of the imaginary component Im(Z) of the overall impedance Z of the power supply cable to be connected, the electronic component and the induction coil is smaller than the real component Re(Z) for any arbitrary length of the power supply cable.

* * * * *